US010640345B2

(12) United States Patent
Ijadi-Maghsoodi et al.

(10) Patent No.: US 10,640,345 B2
(45) Date of Patent: May 5, 2020

(54) SEALED RESCUE HOIST DRUM BELLOW SYSTEM

(71) Applicant: Goodrich Corporation, Charlotte, NC (US)

(72) Inventors: Bejan Ijadi-Maghsoodi, Diamond Bar, CA (US); William Teel, Arcadia, CA (US)

(73) Assignee: Goodrich Corporation, Charlotte, NC (US)

( * ) Notice: Subject to any disclaimer, the term of this patent is extended or adjusted under 35 U.S.C. 154(b) by 260 days.

(21) Appl. No.: 15/910,785

(22) Filed: Mar. 2, 2018

(65) Prior Publication Data

US 2018/0251351 A1 Sep. 6, 2018

Related U.S. Application Data

(60) Provisional application No. 62/466,855, filed on Mar. 3, 2017.

(51) Int. Cl.
*B66D 1/39* (2006.01)

(52) U.S. Cl.
CPC ..... *B66D 1/39* (2013.01)

(58) Field of Classification Search
CPC ... B66D 1/39; B66D 1/02; B66D 3/26; B66D 2700/0183
See application file for complete search history.

(56) References Cited

U.S. PATENT DOCUMENTS 3,024,001 A * 3/1962 Worden ..... B66D 1/39 254/331
2005/0082015 A1* 4/2005 Altimore ..... E05D 13/1238 160/133
2006/0249717 A1* 11/2006 Conti ..... B25J 17/0266 254/268
2007/0220846 A1* 9/2007 Ray ..... B08B 15/02 55/385.2
2009/0116606 A1* 5/2009 Lee ..... B25J 1/08 376/260
2018/0118530 A1* 5/2018 August ..... B66D 1/12

FOREIGN PATENT DOCUMENTS

DE 691744 C 6/1940
DE 10017599 A1 10/2001
FR 2205470 A1 5/1974
GB 2295604 A * 6/1996 ..... B65H 75/22
WO WO 2008130402 A2 10/2008

OTHER PUBLICATIONS

Extended European Search Report for EP Application No. 18159813.7, dated Jul. 13, 2018, 5 pages.

* cited by examiner

*Primary Examiner* — Emmanuel M Marcelo
(74) *Attorney, Agent, or Firm* — Kinney & Lange, P.A.

(57) ABSTRACT

A rescue hoist includes a cable drum that translates along and rotates around a cable drum axis. The rescue hoist includes various components that are supported on the hoist frame and that extend at least partially through the cable drum. A first bellows is mounted to the frame and attached to a first end of the cable drum, and a second bellows is mounted to the frame and attached to the second end of the cable drum. The first bellows and the second bellows expand and collapse as the cable drum translates, such that the first bellows and the second bellows isolate the rescue hoist components from an operating environment as cable drum translates and rotates.

20 Claims, 3 Drawing Sheets

SEALED RESCUE HOIST DRUM BELLOW SYSTEM

CROSS-REFERENCE TO RELATED APPLICATION(S)

This application claims the benefit of U.S. Provisional Application No. 62/466,855 filed Mar. 3, 2017 for "SEALED RESCUE HOIST DRUM BELLOW SYSTEM".

BACKGROUND

This disclosure relates generally to hoists. More particularly, this disclosure relates to translating body rescue hoists for aircraft.

Rescue hoists deploy and retrieve a cable from a cable drum to hoist persons or cargo, and the rescue hoist may be mounted to an aircraft, such as a helicopter. The cable drum rotates to spool or unspool the cable from the cable drum, with one end of the cable attached to the cable drum and the other end, which can include a hook or other device, deployed during operation. The cable drum is also translated along the cable drum axis to properly align the cable as the cable is spooled onto and unspooled from the cable drum. Various lubricated components of the rescue hoist are at least partially housed within the cable drum, such as a motor, a drive train, a level wind mechanism, and a linear bearing. The lubricated components disposed within the cable drum can be exposed to various contaminants as the cable drum translates, because as the cable drum translates the lubricated components typically remain stationary.

SUMMARY

According to one aspect of the disclosure, a system for isolating internal components of a rescue hoist from an operating environment includes a cable drum supported on a hoist frame, the cable drum configured to rotate about a cable drum axis and to translate along the cable drum axis, a first bellows extending between and attached to the hoist frame and a first end of the cable drum, and a second bellows extending between and attached to the hoist frame and a second end of the cable drum. The cable drum is rotatable relative to the first bellows and the second bellows.

According to another aspect of the disclosure, a rescue hoist includes a cable drum supported on a hoist frame, the cable drum configured to rotate about a cable drum axis and to translate along the cable drum axis, a drive system at least partially disposed within the cable drum, the drive system powering the cable drum for rotation about the cable drum axis, a level wind mechanism connected to the cable drum, the level wind mechanism driving the cable drum to translate along the cable drum axis, a first bellows extending between and attached to the hoist frame and a first end of the cable drum, and a second bellows extending between and attached to the hoist frame and a second end of the cable drum. The cable drum is rotatable relative to the first bellows and the second bellows.

According to yet another aspect of the disclosure, a method of isolating components of a rescue hoist from the environment includes enclosing a first end of a cable drum with a first bellows attached to a frame of the rescue hoist, the first bellows configured to contract as the cable drum translates in a first direction and to expand as the cable drum translates in a second direction, enclosing a second end of the cable drum with a second bellows attached to the frame of the rescue hoist, the second bellows configured to expand as the cable drum translates in the first direction and contract as the cable drum translates in the second direction, supporting the first bellows on the cable drum with a first bearing disposed between a first bellows translating end and a first bearing support extending axially from the first end of the cable drum, and supporting the second bellows on the cable drum with a second bearing disposed between a second bellows translating end and a second bearing support extending axially from the second end of the cable drum.

DETAILED DESCRIPTION

Figure 1A:
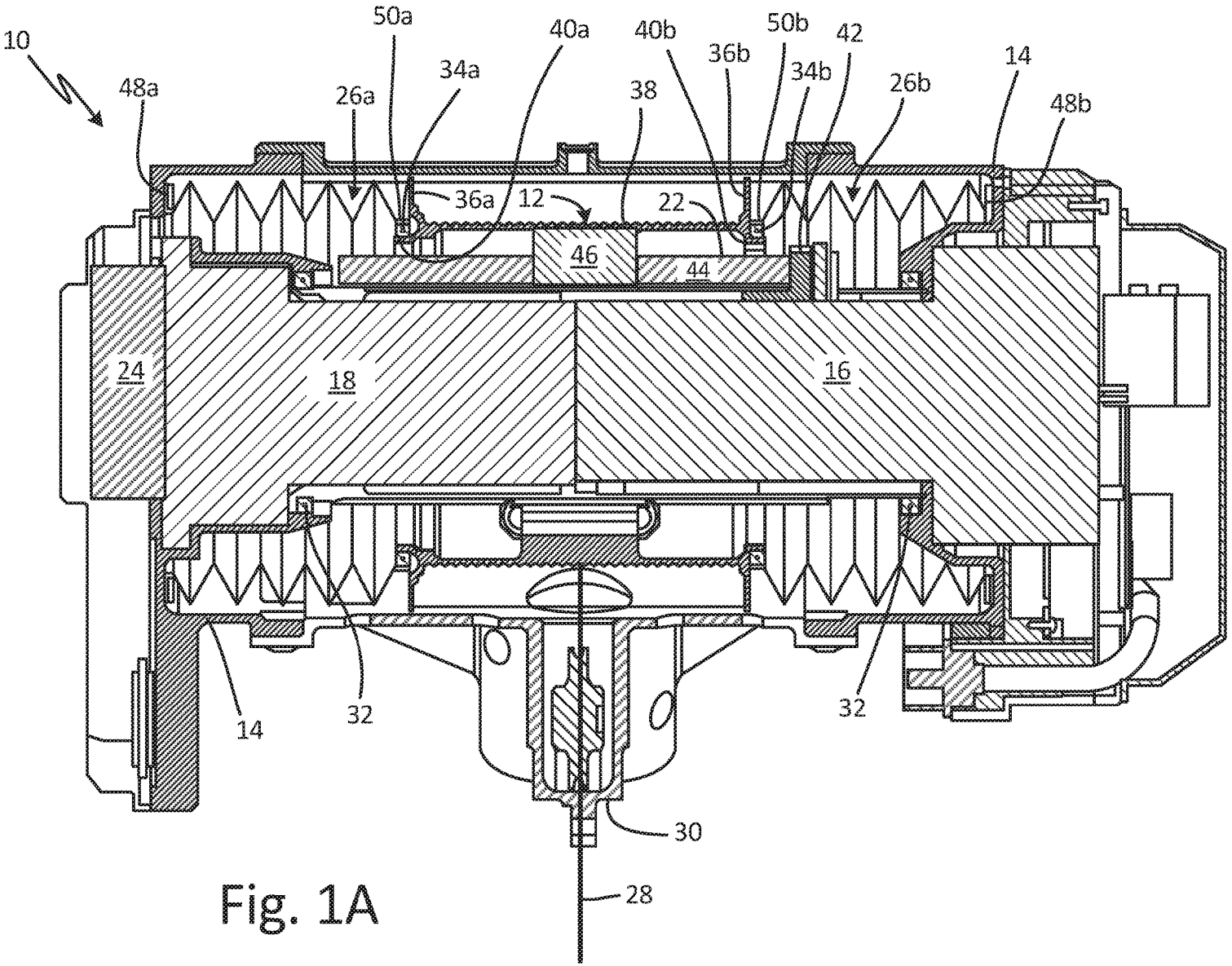
FIG. 1A is a cross-sectional view of a rescue hoist with a cable drum in a centered position.
Figure 1B:
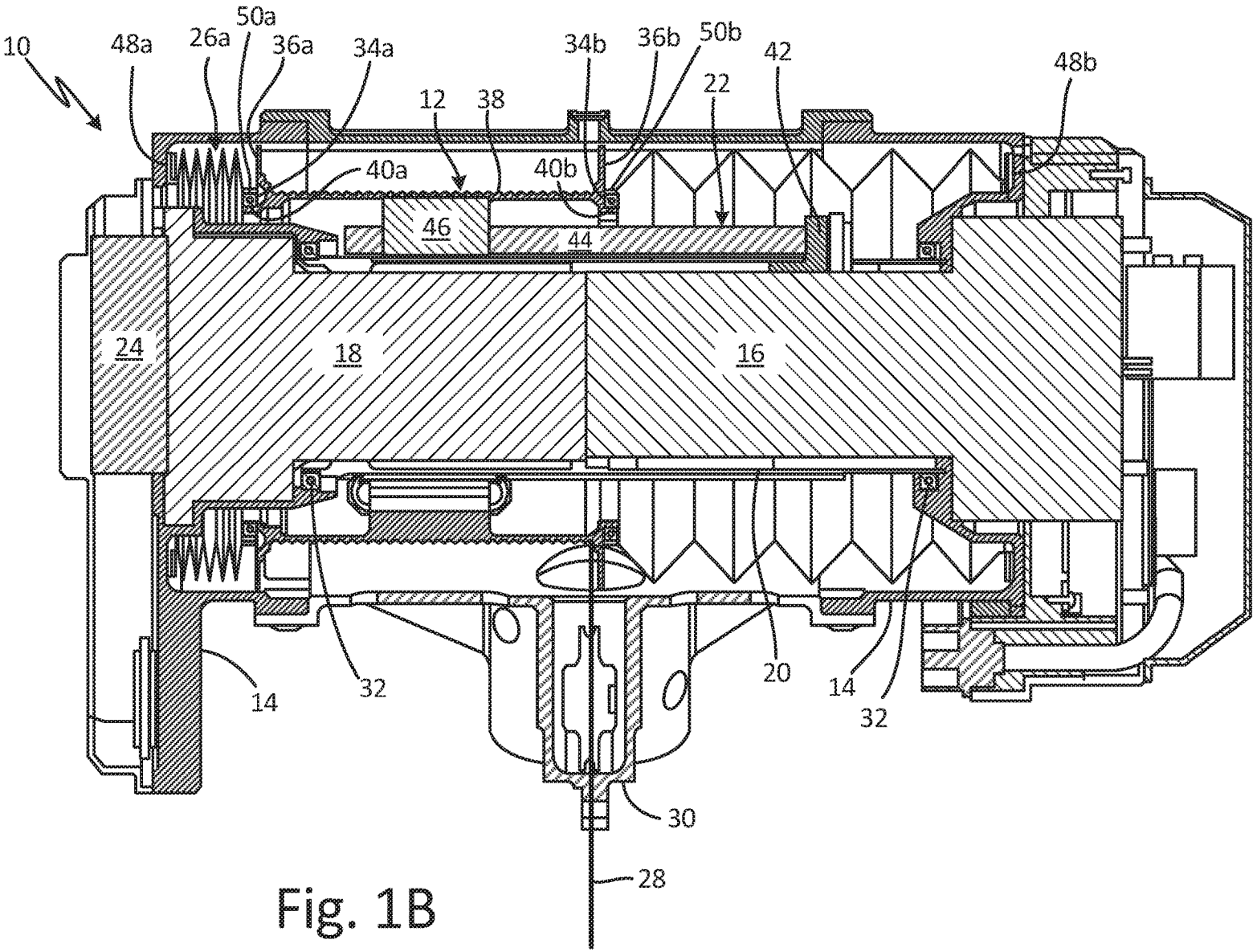
FIG. 1B is a cross-sectional view of a rescue hoist with a cable drum in a first displaced position.
Figure 1C:
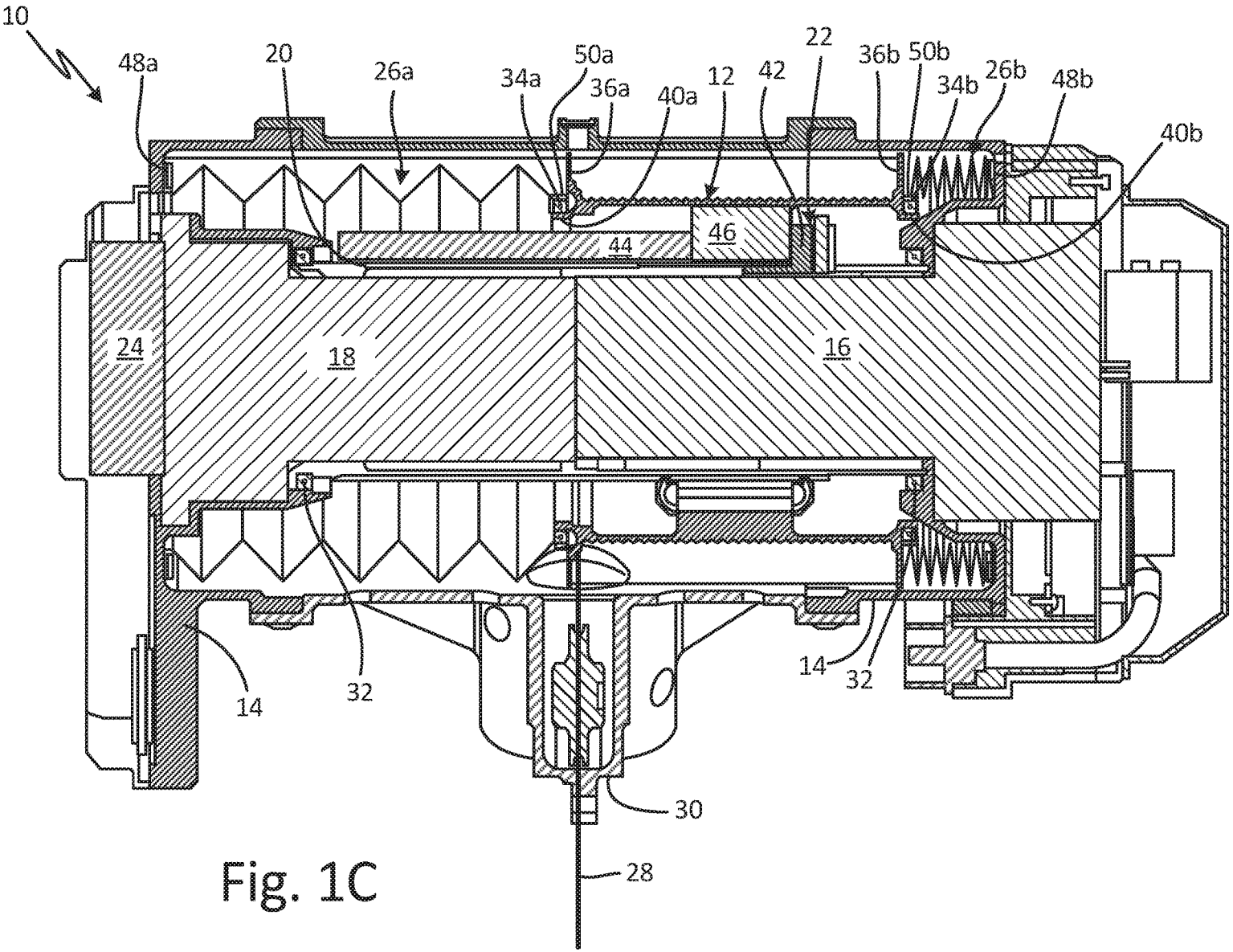
FIG. 1C is a cross-sectional view of a rescue hoist with a cable drum in a second displaced position.

FIG. 1A is a cross-sectional view of rescue hoist 10 with cable drum 12 in a neutral position. FIG. 1B is a cross-sectional view of rescue hoist 10 with cable drum 12 in a first displaced position. FIG. 1C is a cross-sectional view of rescue hoist 10 with cable drum 12 in a second displaced position. FIGS. 1A-1C will be discussed together. Rescue hoist 10 includes cable drum 12, frame 14, motor 16, drive train 18, linear bearing 20, level wind mechanism 22, pump 24, first bellows 26*a*, second bellows 26*b*, cable 28, cable guide 30, support bearings 32, first bearing 34*a*, and second bearing 34*b*. Cable drum 12 includes radial flange 36*a*, radial flange 36*b*, barrel 38, bearing support 40*a*, and bearing support 40*b*. Level wind mechanism 22 includes mount 42, screw 44, and follower 46. First bellows 26*a* includes fixed end 48*a* and translating end 50*a*. Second bellows 26*b* includes fixed end 48*b* and translating end 50*b*.

Linear bearing 20 is rotatably mounted to frame 14 by support bearings 32 and is configured to rotate about cable drum axis A-A. Motor 16 is mounted to frame 14 and extends into linear bearing 20. Similarly, drive train 18 is mounted to frame 14 and extends into linear bearing 20. Drive train 18 is a gear reduction drive connected to both motor 16 and linear bearing 20. Drive train 18 receives rotational power from motor 16, reduces the speed of the input from motor 16, and outputs rotational power to linear bearing 20, thereby driving linear bearing 20 about cable drum axis A-A. Pump 24, which, in some embodiments can be a lubricant pump, is mounted to drive train 18 and configured to be driven by the gears of drive train 18. Pump 24 provides lubricant to various lubricated components of drive train 18 and motor 16. Level wind mechanism 22 is attached to linear bearing 20 by mount 42. As such, level wind mechanism 22 rotates about cable drum axis A-A with linear bearing 20. Screw 44 extends from mount 42 and is at least partially disposed within cable drum 12. Follower 46 is mounted to barrel 38 of cable drum 12, and follower 46 engages with screw 44.

Cable drum 12 is mounted on and supported by linear bearing 20. Barrel 38 extends between and connects radial flange 36*a* and radial flange 36*b*. Cable 28 wraps around barrel 38 cable drum 12 and is disposed on barrel 38 between radial flange 36*a* and radial flange 36*b*. Bearing support 40*a* extends axially from barrel 38 proximate radial flange 36*a*. Similarly, bearing support 40*b* extends axially from barrel 38 proximate radial flange 36*b*. Bearing support 40*a* supports first bearing 34*a* on cable drum 12*a*, and bearing support 40*b* supports second bearing 34*b* on cable drum 12. In some embodiments, bearing support 40*a* is the inner race of first bearing 34*a* and bearing support 40*b* is the inner race of second bearing 34*b*. In other embodiments, bearing support 40*a* can capture and support the inner race of first bearing 34*a*, and bearing support 40*b* can capture and support the inner race of second bearing 34*b*. In some embodiments, bearing support 40*a* can be a first axial flange extending from cable drum 12 proximate radial flange 36*a*, and bearing support 40*b* can be a second axial flange extending from cable drum proximate radial flange 36*b*, for example. In some embodiments, bearing support 40*a* and bearing support 40*b* can form an inner housing of first bearing 34*a* and second bearing 34*b*, respectively, to support the inner races of first bearing 34*a* and second bearing 34*b*. While bearing support 40*a* and bearing support 40*b* are described as forming or supporting the inner race of first bearing 34*a* and second bearing 34*b*, respectively, it is understood that in some embodiments bearing support 40*a* and bearing support 40*b* can be disposed radially outward of translating end 50*a* and translating end 50*b*, and can thus form or support the outer races of first bearing 34*a* and second bearing 34*b*.

First bellows 26*a* is disposed in rescue hoist 10 and encloses various components of rescue hoist 10 that extend within cable drum 12, such as motor 16, drive train 18, pump 24, linear bearing 20, and level wind mechanism 22, for example. Fixed end 48*a* of first bellows 26*a* is mounted to frame 14. Translating end 50*a* of first bellows 26 is attached to first bearing 34*a*. In some embodiments, translating end 50*a* forms the outer race of first bearing 34*a*; in other embodiments, translating end 50*a* is attached to and supports the outer race of first bearing 34*a*. First bearing 34*a* is thus disposed between and connects first bellows 26*a* and cable drum 12. In some embodiments, translating end 50*a* can from an outer bearing housing of first bearing 34*a* configured to support the outer race of first bearing 34*a*, and translating end 50*b* can form an outer bearing housing of second bearing 34*b* configured to support the outer race of second bearing 34*b*. While translating end 50*a* and translating end 50*b* are described as forming or supporting the outer race of first bearing 34*a* and second bearing 34*b*, respectively, it is understood that in some embodiments translating end 50*a* and translating end 50*b* can be disposed radially inward of bearing support 40*a* and bearing support 40*b* and can thus form or support the inner races of first bearing 34*a* and second bearing 34*b*.

Similar to first bellows 26*a*, second bellows 26*b* is disposed in rescue hoist 10 and encloses various components of rescue hoist 10, such as motor 16, drive train 18, pump 24, linear bearing 20, and level wind mechanism 22, for example. Fixed end 48*b* of second bellows 26*b* is mounted to frame 14. Translating end 50*b* of second bellows 26*b* is attached to second bearing 34*b*. In some embodiments, translating end 50*b* forms the outer race of second bearing 34*b*, in other embodiments, translating end 50*b* is attached to and supports the outer race of second bearing 34*b*. Second bearing 34*b* is thus disposed between and connects second bellows 26*b* and cable drum 12.

First bearing 34*a* can be any suitable bearing for supporting translating end 50*a* on bearing support 40*a*. In some embodiments, first bearing 34*a* is a radial bearing, such as a radial ball bearing, for example. Similarly, second bearing 34*b* can be any suitable bearing for supporting translating end 50*b* on bearing support 40*b*. In some embodiments, second bearing 34*b* is a radial bearing, such as a radial ball bearing, for example.

Cable drum 12 is configured to rotate about and translate along cable drum axis A-A. Rotating cable drum 12 causes cable 28 to unspool from and/or spool onto cable drum 12, depending on the direction of rotation of cable drum 12. In one embodiment, linear bearing 20 is a ball spline bearing, and as such linear bearing 20 is capable of transmitting torque to cable drum 12 to thereby cause cable drum 12 to rotate about cable drum axis A-A to spool cable 28 onto cable drum 12 or unspool cable 28 from cable drum 12, while also allowing cable drum 12 to translate along cable drum axis A-A. Cable 28 exits rescue hoist 10 through cable guide 30. Cable guide 30 is a stationary payout point through which cable 28 exits rescue hoist 10. Because cable guide 30 remains stationary as cable 28 both unspools from and spools onto cable drum 12, cable drum 12 translates along cable drum axis A-A to ensure that cable 28 is levelly wound onto cable drum 12. Translating cable drum 12 along cable drum axis A-A also aligns cable 28 with cable guide 30 throughout the winding process. Follower 46 meshes with threads on screw 44, such that follower 46 displaces axially along screw 44 as screw 44 rotates. Rotating screw 44 thus causes cable drum 12 to translate along cable drum axis A-A due to the connection of follower 46 and cable drum 12. In this way, level wind mechanism 22 causes cable drum 12 to oscillate along cable drum 12 axis A-A as cable drum 12 rotates about cable drum axis A-A.

First bellows 26*a* and second bellows 26*b* translate with cable drum 12. As cable drum 12 translates in a first direction from a neutral position, shown in FIG. 1A, to a first displaced position, shown in FIG. 1B, first bellows 26*a* collapses and second bellows 26*b* expands, thereby isolating various components and the lubricant provided to those components of rescue hoist 10 from an operating environment as cable drum 12 translates in the first direction. It is understood that in some embodiments the operating environment can include any environment suitable for using rescue hoist 10. For example, in some embodiments the operating environment includes the environment outside of rescue hoist 10. In some embodiments, the operating environment includes the environment outside of rescue hoist 10 and inside of rescue hoist 10 but radially outside of cable drum 12. Isolating the various components of rescue hoist 10 protects the components and the lubricant within those components from being contaminated by particles that can enter the rescue hoist 10 from the operating environment. As cable drum 12 translates, cable drum 12 simultaneously rotates about cable drum axis A-A to deploy or retrieve cable 28. Cable drum 12 rotates relative to first bellows 26*a* due to first bearing 34*a* extending between and connecting first bellows 26*a* and cable drum 12*a*. Similarly, cable drum 12 rotates relative to second bellows 26*b* due to second bearing 34*b* extending between and connecting second bellows 26*b* and cable drum 12*b*.

After cable drum 12 displaces in the first direction, cable drum 12 reverses and translates through the neutral position, shown in FIG. 1A, to a second displaced position, shown in FIG. 1C. As cable drum 12 displaces to the second position, first bellows 26*a* expands from the position shown in FIG. 1B to the position shown in FIG. 1C, and second bellows 26*b* contracts from the position shown in FIG. 1B to the position shown in FIG. 1C. First bellows 26*a* and second bellows 26*b* thus travel with cable drum 12 and isolate and protect the various components disposed within first bellows 26*a*, second bellows 26*b*, and cable drum 12 over a full translation range of cable drum 12.

First bellows 26*a* and second bellows 26*b* allow cable drum 12 to freely translate along cable drum axis A-A and to rotate about cable drum axis A-A, while also isolating and protecting various components of rescue hoist 10 over the full translation range of cable drum 12. First bellows 26*a* and second bellows 26*b* are relatively lightweight and high strength. In some embodiments, one or both of first bellows 26*a* and second bellows 26*b* are extruded or sewn together, such as from individual panels. In some embodiments, one or both of first bellows 26*a* and second bellows 26*b* are manufactured from rubber, metal, plastic, or cloth.

First bellows 26*a* and second bellows 26*b* provide significant advantages. First bellows 26*a* and second bellows 26*b* isolate various components of rescue hoist 10 from the operating environment, thereby preventing various particles, such as dust and exhaust, from being ingested by the components. In some embodiments, the components protected by first bellows 26*a* and second bellows 26*b* can include motor 16, drive train 18, pump 24, linear bearing 20, and level wind mechanism 22, among others. First bellows 26*a* and second bellows 26*b* also isolate bearings, such as support bearings 32 and linear bearing 20, supporting various rotating components of rescue hoist 10, which, in some embodiments, can include linear bearing 20, cable drum 12, and level wind mechanism 22, among other components. Isolating the components and lubricant reduces the maintenance requirements of rescue hoist 10 and increases the lifespan of the components and lubricant. In addition, first bellows 26*a* and second bellows 26*b* also allow cable drum 12 to rotate around and translate along cable drum axis A-A simultaneously, such as through first bearing 34*a* and second bearing 34*b*, for example, thereby allowing rescue hoist 10 to have a single-point payout, in some embodiments. Moreover, first bellows 26*a* and second bellows 26*b* are relatively lightweight, minimizing any weight gain to rescue hoist 10.

Discussion of Possible Embodiments

The following are non-exclusive descriptions of possible embodiments of the present invention.

A system for isolating internal components of a rescue hoist from the environment includes a cable drum supported on a hoist frame, the cable drum configured to rotate about a cable drum axis and to translate along the cable drum axis, a first bellows extending between and attached to the hoist frame and a first end of the cable drum, and a second bellows extending between and attached to the hoist frame and a second end of the cable drum. The cable drum is rotatable relative to the first bellows and the second bellows.

The system of the preceding paragraph can optionally include, additionally and/or alternatively, any one or more of the following features, configurations and/or additional components:

A linear bearing rotatably mounted to the frame, the linear bearing extending through the cable drum and supporting the cable drum on the frame.

At least one bearing rotatably supporting the linear bearing on the frame

A first bearing support extending axially from the first end of the cable drum, the first bearing support supporting a first bearing disposed between the cable drum and the first bellows, and a second bearing support extending axially from the second end of the cable drum, the second bearing support supporting a second bearing disposed between the cable drum and the second bellows.

The first bearing support comprises a first axial flange supporting a first bearing inner race.

The first bearing support comprises a first bearing housing.

The first bearing housing comprises a first bearing inner housing.

The first bearing support comprises a first bearing inner race.

The first bellows comprises a first fixed end attached to the frame and a first translating end mounted to the cable drum, the first translating end supported on the first bearing, the first bellows isolating internal components of the rescue hoist from the operating environment, and the second bellows comprises a second fixed end attached to the frame and a second translating end mounted to the cable drum, the second translating end supported on the second bearing, the second bellows isolating internal components of the rescue hoist from the operating environment.

The first translating end captures a first bearing outer race.

The first translating end is a first bearing outer race.

A first radial bearing disposed between the first end of the cable drum and the first bellows, and a second radial bearing disposed between the second end of the cable drum and the second bellows.

A rescue hoist includes a cable drum supported on a hoist frame, the cable drum configured to rotate about a cable drum axis and to translate along the cable drum axis, a drive system at least partially disposed within the cable drum, the drive system powering the cable drum for rotation about the cable drum axis, a level wind mechanism connected to the cable drum, the level wind mechanism driving the cable drum to translate along the cable drum axis, a first bellows extending between and attached to the hoist frame and a first end of the cable drum, and a second bellows extending between and attached to the hoist frame and a second end of the cable drum. The cable drum is rotatable relative to the first bellows and the second bellows.

The rescue hoist of the preceding paragraph can optionally include, additionally and/or alternatively, any one or more of the following features, configurations and/or additional components:

A linear bearing rotatably mounted to the frame, the linear bearing extending through the cable drum and supporting the cable drum on the frame.

The drive system includes a motor mounted to the frame and extending into the linear bearing, and a drive train mounted to the frame and extending into the linear bearing, the drive train configured to receive rotational power from the motor and transmit rotational power to the linear bearing.

A first bearing support extending axially from the first end of the cable drum, the first bearing support supporting a first bearing disposed between the cable drum and the first bellows, and a second bearing support extending axially from the second end of the cable drum, the second bearing support supporting a second bearing disposed between the cable drum and the second bellows.

The first bellows comprises a first fixed end attached to the frame and a first translating end mounted to the cable drum, the first translating end supported on the first bearing, the first bellows isolating the linear bearing and the level wind mechanism from an operating environment, and the second bellows comprises a second fixed end attached to the frame and a second translating end mounted to the cable drum, the second translating end supported on the second bearing, the second bellows isolating the linear bearing and the level wind mechanism from the operating environment.

A first radial bearing disposed between the first end of the cable drum and the first bellows, and a second radial bearing disposed between the second end of the cable drum and the second bellows.

A cable guide extending through the frame, a cable of the rescue hoist extending through the cable guide, wherein the cable guide is fixed on the frame as the cable is deployed through or recalled through the cable guide.

A method of isolating components of a rescue hoist from the environment includes enclosing a first end of a cable drum with a first bellows attached to a frame of the rescue hoist, the first bellows configured to contract as the cable drum translates in a first direction and to expand as the cable drum translates in a second direction, enclosing a second end of the cable drum with a second bellows attached to the frame of the rescue hoist, the second bellows configured to expand as the cable drum translates in the first direction and contract as the cable drum translates in the second direction, supporting the first bellows on the cable drum with a first bearing disposed between a first bellows translating end and a first bearing support extending axially from the first end of the cable drum, and supporting the second bellows on the cable drum with a second bearing disposed between a second bellows translating end and a second bearing support extending axially from the second end of the cable drum.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for isolating internal components of a rescue hoist from an operating environment, the system comprising:

a cable drum supported on a hoist frame, the cable drum configured to rotate about a cable drum axis and to translate along the cable drum axis;

a first bellows extending between and attached to the hoist frame and a first end of the cable drum; and a second bellows extending between and attached to the hoist frame and a second end of the cable drum;

wherein the cable drum is rotatable relative to the first bellows and the second bellows.

2. The system of claim 1, further comprising:

a linear bearing rotatably mounted to the frame, the linear bearing extending through the cable drum and supporting the cable drum on the frame.

3. The system of claim 2, further comprising at least one bearing rotatably supporting the linear bearing on the frame.

4. The system of claim 1, further comprising:

a first bearing support extending axially from the first end of the cable drum, the first bearing support supporting a first bearing disposed between the cable drum and the first bellows; and a second bearing support extending axially from the second end of the cable drum, the second bearing support supporting a second bearing disposed between the cable drum and the second bellows.

5. The system of claim 4, wherein the first bearing support comprises a first axial flange supporting a first bearing inner race.

6. The system of claim 4, wherein the first bearing support comprises a first bearing housing.

7. The system of claim 6, wherein the first bearing housing comprises a first bearing inner housing.

8. The system of claim 4, wherein the first bearing support comprises a first bearing inner race.

9. The system of claim 1, wherein:

the first bellows comprises a first fixed end attached to the frame and a first translating end mounted to the cable drum, the first translating end supported on the first bearing, the first bellows isolating internal components of the rescue hoist from the operating environment; and the second bellows comprises a second fixed end attached to the frame and a second translating end mounted to the cable drum, the second translating end supported on the second bearing, the second bellows isolating internal components of the rescue hoist from the operating environment.

10. The system of claim 9, wherein the first translating end supports a first bearing outer race.

11. The system of claim 9, wherein the first translating end is a first bearing outer race.

12. The system of claim 1, further comprising:

a first radial bearing disposed between the first end of the cable drum and the first bellows; and a second radial bearing disposed between the second end of the cable drum and the second bellows.

13. A rescue hoist comprising:

a cable drum supported on a hoist frame, the cable drum configured to rotate about a cable drum axis and to translate along the cable drum axis;

a drive system at least partially disposed within the cable drum, the drive system powering the cable drum for rotation about the cable drum axis;

a level wind mechanism connected to the cable drum, the level wind mechanism driving the cable drum to translate along the cable drum axis;

a first bellows extending between and attached to the hoist frame and a first end of the cable drum, wherein the cable drum is rotatable relative to the first bellows; and a second bellows extending between and attached to the hoist frame and a second end of the cable drum, wherein the cable drum is rotatable relative to the second bellows.

14. The rescue hoist of claim 13, further comprising:

a linear bearing rotatably mounted to the frame, the linear bearing extending through the cable drum and supporting the cable drum on the frame.

15. The rescue hoist of claim 14, wherein the drive train comprises:

a motor mounted to the frame and extending into the linear bearing; and a drive train mounted to the frame and extending into the linear bearing, the drive train configured to receive rotational power from the motor and transmit rotational power to the linear bearing.

16. The rescue hoist of claim 14, further comprising:

a first bearing support extending axially from the first end of the cable drum, the first bearing support supporting a first bearing disposed between the cable drum and the first bellows; and a second bearing support extending axially from the second end of the cable drum, the second bearing support supporting a second bearing disposed between the cable drum and the second bellows.

17. The rescue hoist of claim 16, wherein:

the first bellows comprises a first fixed end attached to the frame and a first translating end mounted to the cable drum, the first translating end supported on the first bearing, the first bellows isolating the linear bearing and the level wind mechanism from an operating environment; and the second bellows comprises a second fixed end attached to the frame and a second translating end mounted to the cable drum, the second translating end supported on the second bearing, the second bellows isolating the linear bearing and the level wind mechanism from the operating environment.

18. The rescue hoist of claim 13, further comprising:

a first radial bearing disposed between the first end of the cable drum and the first bellows; and a second radial bearing disposed between the second end of the cable drum and the second bellows.

19. The rescue hoist of claim 13, further comprising:

a cable guide extending through the frame, a cable of the rescue hoist extending through the cable guide, wherein the cable guide is fixed on the frame as the cable is deployed through or recalled through the cable guide.

20. A method of isolating components of a rescue hoist, the method comprising:

enclosing a first end of a cable drum with a first bellows attached to a frame of the rescue hoist, the first bellows configured to contract as the cable drum translates in a first direction and to expand as the cable drum translates in a second direction;

enclosing a second end of the cable drum with a second bellows attached to the frame of the rescue hoist, the second bellows configured to expand as the cable drum translates in the first direction and contract as the cable drum translates in the second direction;

supporting the first bellows on the cable drum with a first bearing disposed between a first bellows translating end and a first bearing support extending axially from the first end of the cable drum; and supporting the second bellows on the cable drum with a second bearing disposed between a second bellows translating end and a second bearing support extending axially from the second end of the cable drum.

* * * * *